United States Patent [19]

Sharp

[11] 4,278,052

[45] Jul. 14, 1981

[54] BOILER CONTROL SYSTEM

[75] Inventor: Everett H. Sharp, Huntington, N.Y.

[73] Assignee: Leeds & Northrup Company, North Wales, Pa.

[21] Appl. No.: 79,279

[22] Filed: Sep. 27, 1979

[51] Int. Cl.[3] ..... F22D 1/28

[52] U.S. Cl. ..... 122/449; 110/103; 110/328; 236/14; 236/15 BD

[58] Field of Search ..... 122/449; 236/15BD, 14; 110/103, 163, 251, 265, 328

[56] References Cited

U.S. PATENT DOCUMENTS 3,284,615 11/1966 Yetter ..... 236/14

4,181,099 1/1980 Binstock ..... 236/15 BD

*Primary Examiner*—Ronald C. Capossela

*Attorney, Agent, or Firm*—William G. Miller, Jr.; Raymond F. MacKay

[57] ABSTRACT

A boiler control system for boilers fired by solid fuels wherein the fuels are carried through the combustion zone of the boiler on a traveling grate and wherein the air flow for combustion as supplied to the undergrate region utilizes a control of the fuel rate from a deviation of the outlet pressure from the desired value with the control of the air flow to the undergrate region maintained generally in proportion to the steam flow from the boiler with the proportionality being biased from the deviation of the outlet pressure from its desired value.

4 Claims, 1 Drawing Figure

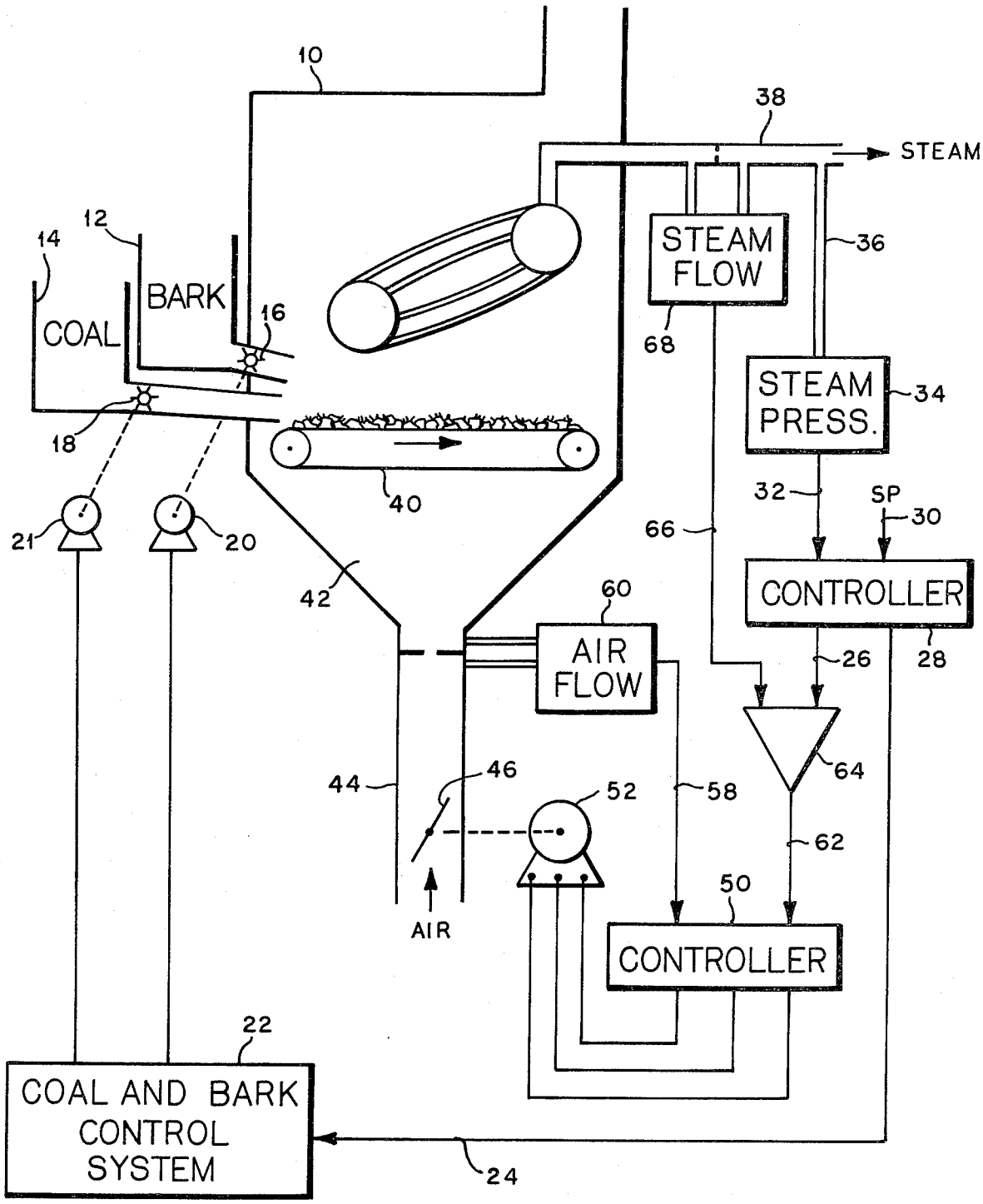
10
38
STEAM
12
14
BARK
COAL
16
STEAM FLOW
36
68
STEAM PRESS.
34
18
40
32
SP
30
21
20
66
CONTROLLER
42
60
AIR FLOW
26
28
64
44
46
52
58
62
50
AIR
CONTROLLER
22
COAL AND BARK CONTROL SYSTEM
24

BOILER CONTROL SYSTEM

BACKGROUND OF THE INVENTION

This invention relates to boiler control systems for boilers fired by solid fuels where the solid fuels are carried through the combustion zone by a traveling grate and wherein the air flow for combustion is supplied to the undergrate region. It has been well known in the art to control the air flow in the undergrate region of such boilers in direct proportion to the steam flow from the boiler so as to maintain the desired air to fuel ratio as the load on the boiler varies.

This method for controlling the flow of undergrate air, however, has not proved to be adequate for the maintenance of close control of steam pressure in systems where the supply of solid fuel to the grate is controlled in response to deviations of the steam outlet pressure. This results from the inherent lag in the change in heat released to the boiler when a change has been made in the fuel feed rate in response to the deviation from the desired steam outlet pressure. These lags, of course, result from the fact that the traveling grate requires a certain amount of time to provide a change in BTU input to the boiler.

It is thus an object of the present invention to provide an improved control system for a boiler firing solid fuels onto a traveling grate to provide closer control of the steam outlet pressure where the rate of fuel feed is being controlled from outlet pressure deviation.

SUMMARY OF THE INVENTION

This invention provides a means for providing closer control of the steam outlet pressure in boilers fired by solid fuels carried through the combustion zone by a traveling grate wherein the air flow for combustion is supplied to the undergrate region. The improved method of control utilizes the variation of the undergrate air flow in direct proportion to the change in steam flow from the boiler with the improvement which is provided by modifying the variation of the air flow produced in response to changes in steam flow in accordance with the deviation of the steam pressure in the boiler outlet from its setpoint so that the variations in the air flow produced in response to the said deviation is inversely related to said deviation to provide the desired closer control of steam pressure.

BRIEF DESCRIPTION OF THE DRAWING

The FIGURE shows in block diagram form the control system of the invention as it can be applied to a boiler firing solid fuels onto a traveling grate.

DESCRIPTION OF THE PREFERRED EMBODIMENT

In the figure there is shown a boiler 10 which is fired by solid fuels. In this case there is shown, for example, a storage container 12 which contains bark and another storage container 14 which contains coal. The rate at which bark and/or coal is fed to the boiler is under control of the feeders 16 and 18 respectively. These feeders are capable of modifying the rate of feed of the bark or coal to the boiler in dependence upon the speed at which the respective motors 20 and 21 are rotated in response to the control signals supplied by the control system 22.

As shown in the figure, the control system 22 operates in response to the control signal supplied on line 24 from the controller 28. The controller 28 operates in response to the difference between the setpoint or desired steam pressure represented by an electrical signal on line 30 and the signal on line 32, which is proportional to the steam pressure measured by the steam pressure measuring instrument 34, shown connected by the pressure measuring tap 36 to the outlet steam line 38 of boiler 10. The controller 28 then produces on line 24 a control signal which can include a proportional, reset and rate response to the pressure deviation. That deviation is also represented by a signal on line 26.

It is, of course, well known to modify the rate of fuel input to a boiler in response to the deviation of the outlet steam pressure from its desired value, and therefore the details of the control system 22 and controller 28 are not discussed further since any of a number of known control systems can be used as long as they are designed to control the supply of several fuels such as bark and coal where the performance of one fuel is different than the other.

It is, of course, understood that the boiler 10 may be fired with fluid fuels such as oil or gas as may be desirable to provide a back-up for the solid fuels, which are generally less expensive as a source of heat than fluid fuels.

The feeding arrangements shown for the solid fuels are representative only, for there are many feed systems which can be used to supply solid fuels to a traveling grate such as the grate 40 shown in boiler 10. The grate is, of course, kept in motion so as to move the fuels deposited on one end of the grate through the combustion zone of the furnace of boiler 10 toward the other end of the grate while combustion air is supplied to the undergrate region 42 by way of the air duct 44 under the control of a butterfly valve 46. Thus, the air for combustion of the fuels on grate 40 tends to lift the solid fuel further off of the grate with increased air flow in the undergrate region, thus causing an increased burning rate as the fuel is suspended above the grate due to the increased surface area for contact of the air with the fuel as the air streams through the grate. Thus, as a result of the increase in the surface exposed to the air streaming through the grate as the rate of air flow increases, the number of BTU's released by the burning fuel is increased beyond what would normally be expected for that increase in air flow. In other words, the increased air flow places the fuel in a position where it can burn at a more rapid rate and hence provide a greater heat release to the boiler for a particular change in air flow than would be expected with other types of fuels such as fluid fuels.

In order to take advantage of this effect when solid fuels are fired onto a traveling grate, there is provided by the arrangement shown in the figure a means for providing closer control of the steam pressure than would be possible if the undergrate air supply was modified only in response to steam flow changes. Thus, the controller 50, which serves to position the butterfly valve 46 by way of the positioning motor 52 responds to the difference between the signal on line 62 which is proportional to the steam flow signal on line 66 as biased by the pressure deviation signal on line 26 and the signal on line 58 which is proportional to the undergrate air flow as measured by the flowmeter 60. The input on line 62 is from the differential amplifier 64 which has as one of its inputs the signal on line 66 which is derived from steam flow meter 68 and is proportional to the measured steam flow in the boiler outlet 38.

In the prior art systems, the undergrate air flow would have been controlled wholly from the signal on line 66; however, with the arrangement of this invention, that control is modified in accordance with the deviation of the steam pressure as by the introduction of the deviation signal on line 26 from controller 28 to amplifier 64. The signal on line 26 which is proportional to the difference between the signals on lines 30 and 32 is such that there will be produced an increase in the undergrate air flow when the steam pressure, as measured by the pressure meter 34, drops below the setpoint represented by the signal on line 30. Thus, as the load on the boiler is increased causing an increase in steam flow, there is an accompanying drop in steam pressure which, by way of controllers 22 and 28, serves to increase the rate at which fuel is fed to the grate. However, that pressure would continue to drop unless provision was made for a more rapid increase of BTU to boiler 10 than can be accomplished by increasing the rate of fuel to the grate. This increase in BTU input is provided by utilizing the steam pressure deviation signal on line 26 to modify or bias the usual control of undergrate air from steam flow so that with an increase in load on the boiler, a change in undergrate air flow is greater than would be the case with the prior art and is greater by an amount which is related to the steam pressure deviation. Thus, the control system of the figure provides for a close control of steam pressure in a system wherein there are inherent difficulties in keeping close control of steam pressure by virtue of the inherent lag in the change in the BTU input to the boiler which occurs in response to the change in fuel feed rate.

What is claimed is:

1. In a control system for a boiler fired by solid fuels which are carried through the boiler combustion zone by a traveling grate, wherein the air for combustion is supplied to the undergrate region in an amount which is varied directly with the steam flow from the boiler to maintain the desired air to fuel ratio, and the rate at which fuel is supplied to the grate is controlled to tend to maintain the steam pressure at the boiler outlet at its desired value, the improvement which comprises:

means for modifying the magnitude of said variation of air flow in accordance with the deviation of the steam pressure in the boiler outlet from its setpoint so that as the steam pressure changes air flow is caused to change in an opposite sense.

2. A control system for controlling the fuel supply rate and the combustion air supply rate for a boiler fired by solid fuels which are carried through the combustion zone of the boiler by a traveling grate, comprising:

means responsive to the deviation of the steam outlet pressure of the boiler from its desired value for controlling the fuel feed rate to minimize said deviation;

means responsive to the steam flow in said outlet for controlling the flow of combustion air to the undergrate region to tend to be directly proportional to the steam flow; and means responsive to said pressure deviation for modifying said air flow control so as to bias said proportional relationship to further modify said air flow to tend to reduce said deviation.

3. Apparatus as set forth in claim 2 in which said means for controlling the fuel feed rate includes means for selectively controlling the feed rate of each of two solid fuels being fired.

4. The method for controlling the fuel supply rate and the combustion air supply rate for a boiler fired by solid fuels which are carried through the combustion zone of the boiler by a traveling grate which comprises the steps of:

controlling the fuel feed rate of the boiler to minimize the deviation of the steam outlet pressure from its desired value;

controlling the flow of combustion air to the undergrate region of said boiler to tend to maintain the air flow in direct proportion to the steam flow in the boiler outlet; and biasing said proportion in response to said deviation to modify the air flow so as to tend to reduce said deviation.

* * * * *